US011060529B2

(12) United States Patent
Sasaki

(10) Patent No.: US 11,060,529 B2
(45) Date of Patent: Jul. 13, 2021

(54) CENTRIFUGAL COMPRESSOR AND TURBOCHARGER INCLUDING THE SAME

(71) Applicant: MITSUBISHI HEAVY INDUSTRIES ENGINE & TURBOCHARGER, LTD., Sagamihara (JP)

(72) Inventor: Gaku Sasaki, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 99 days.

(21) Appl. No.: 16/609,399

(22) PCT Filed: Nov. 20, 2017

(86) PCT No.: PCT/JP2017/041708
§ 371 (c)(1),
(2) Date: Oct. 29, 2019

(87) PCT Pub. No.: WO2019/097730
PCT Pub. Date: May 23, 2019

(65) Prior Publication Data

US 2020/0049162 A1 Feb. 13, 2020

(51) Int. Cl.
*F04D 29/44* (2006.01)

(52) U.S. Cl.
CPC ..... *F04D 29/441* (2013.01); *F05D 2250/52* (2013.01)

(58) Field of Classification Search
CPC ..... F04D 29/441; F04D 29/002; F04D 29/40; F04D 29/403; F04D 29/42;
(Continued)

(56) References Cited

U.S. PATENT DOCUMENTS 5,266,003 A 11/1993 Warren
9,541,094 B2 * 1/2017 Iwakiri ..... F04D 29/4206
(Continued)

FOREIGN PATENT DOCUMENTS

JP 6-33898 A 2/1994
JP 2012-202323 A 10/2012
(Continued)

OTHER PUBLICATIONS

International Preliminary Report on Patentability and English translation of the Written Opinion of the International Searching Authority for International Application No. PCT/JP2017/041708, dated Jun. 4, 2020.
(Continued)

*Primary Examiner* — Charles G Freay
*Assistant Examiner* — Chirag Jariwala
(74) *Attorney, Agent, or Firm* — Birch, Stewart, Kolasch & Birch, LLP

(57) ABSTRACT

A centrifugal compressor includes an impeller and a housing having a scroll passage of spiral shape formed on an outer peripheral side of the impeller. When a circumferential-directional position of the scroll passage is represented by an angular position with respect to a scroll end of the scroll passage, and in a cross-section obtained by cutting the scroll passage along a plane including a rotational axis of the impeller at a circumferential-directional position where the angular position is θ, F(θ) is defined as: F(θ)=(A/R)/r, where A is a cross-sectional area of the scroll passage, R is a distance from the rotational axis to a scroll center of the cross-section of the scroll passage, and r is a radius of the impeller, $0.35 \leq F(360°) \leq 0.65$, and $0.08 \times F(360°) \leq F(60°) \leq 0.4 \times F(360°)$.

5 Claims, 5 Drawing Sheets

(58) Field of Classification Search
CPC ..... F04D 29/4203; F04D 29/4226; F05D 2250/52; F05D 2250/70
See application file for complete search history.

(56) References Cited

U.S. PATENT DOCUMENTS

| | | | | |
|---|---|---|---|---|
| 2013/0272865 | A1* | 10/2013 | Hoshi | F04D 29/681 415/204 |
| 2013/0294903 | A1* | 11/2013 | Tomita | F04D 29/441 415/204 |

FOREIGN PATENT DOCUMENTS

| | | | |
|---|---|---|---|
| JP | 2015-183670 | A | 10/2015 |
| WO | WO 2009/071621 | A1 | 6/2009 |
| WO | WO 2012/132528 | A1 | 10/2012 |

OTHER PUBLICATIONS

International Search Report for International Application No. PCT/JP2017/041708, dated Feb. 20, 2018.

* cited by examiner

CENTRIFUGAL COMPRESSOR AND TURBOCHARGER INCLUDING THE SAME

TECHNICAL FIELD

The present disclosure relates to a centrifugal compressor and a turbocharger including the centrifugal compressor.

BACKGROUND ART

In recent years, it is desired to enlarge the operating region of a centrifugal compressor. For instance, as automobile engines require more fuel efficiency and acceleration performance in a low speed region, turbochargers require enlarging the operating region at the low speed and low flow rate side. Patent Document 1 discloses a centrifugal compressor which does not aim at enlarging the operating region on the low flow rate side but in which the enlargement rate of the cross-sectional area of a scroll passage is changed along the circumferential direction in order to reduce loss due to separation caused between a tongue and compressed air due to the influence of the tongue, thereby improving the efficiency of the centrifugal compressor.

CITATION LIST

Patent Literature

Patent Document 1: WO2012/132528A

SUMMARY

Problems to be Solved

In an operating region on the low flow rate side of a centrifugal compressor, separation is caused in a scroll passage and decreases the passage area of the flow in the scroll passage. This suddenly increases the internal flow velocity at the separation portion and increases the entropy of the internal flow, resulting in a reduction in efficiency of the centrifugal compressor. Further, separation caused in the scroll passage enters and blocks a diffuser passage. As a result, the internal flow in the diffuser passage is interrupted, and the efficiency of the centrifugal compressor is reduced. In addition, surging occurs. However, the configuration of the centrifugal compressor disclosed in Patent Document 1 does not aim at addressing such factors of reducing the efficiency due to operation in the operating region on the low flow rate side. Since the separation occurrence range disclosed in Patent Document 1 is different from a range where separation occurs in the operating region on the low flow rate side, the operating region on the low flow rate side cannot be enlarged.

In view of the above, an object of at least one embodiment of the present disclosure is to provide a centrifugal compressor and a turbocharger including the centrifugal compressor whereby it is possible to enlarge the operating region on the low flow rate side.

Solution to the Problems (1) A centrifugal compressor according to at least one embodiment of the present disclosure comprises: an impeller; and a housing having a scroll passage of spiral shape formed on an outer peripheral side of the impeller, wherein when a circumferential-directional position of the scroll passage is represented by an angular position with respect to a scroll end of the scroll passage, and in a cross-section obtained by cutting the scroll passage along a plane including a rotational axis of the impeller at a circumferential-directional position where the angular position is $\theta$, $F(\theta)$ is defined as: $F(\theta)=(A/R)/r$, where A is a cross-sectional area of the scroll passage, R is a distance from the rotational axis to a scroll center of the cross-section of the scroll passage, and r is a radius of the impeller, $0.35 \leq F(360°) \leq 0.65$, and $0.08 \times F(360°) \leq F(60°) \leq 0.4 \times F(360°)$.

With the above configuration (1), since $0.35 \leq F(360°) \leq 0.65$ is satisfied, it is possible to balance an increase in friction loss in the operating region on the high flow rate side and a reduction in efficiency due to stall in the operating region on the low flow rate side.

Additionally, since $0.08 \times F(360°) \leq F(60°) \leq 0.4 \times F(360°)$ is satisfied, in the operating region on the low flow rate side, recirculation flow from the scroll passage to the diffuser passage is ensured in the vicinity of the circumferential-directional position at an angular position of 60°. This recirculation flow reduces the occurrence of separation in the scroll passage. As a result, since the occurrence of separation is reduced in the scroll passage, it is possible to enlarge the operating region on the low flow rate side.

(2) In some embodiments, in the above configuration (1), when a reference change rate $\Delta$ which is a change rate of $F(\theta)$ in a range of $\theta$ from 60° to 360° is defined as: $\Delta=[F(360°)-F(60°)]/(360°-60°)$, the scroll passage includes a first region where $F(\theta)$ changes at a smaller change rate than the reference change rate at least partially in a range of $\theta$ from 60° to 270°.

With the above configuration (2), in the first region, since the enlargement rate of the cross-sectional area of the scroll passage is smaller than when $F(\theta)$ changes at the reference change rate, a reduction in flow velocity of the compressed fluid flowing through the scroll passage is suppressed in the first region. Thus, the occurrence of separation is reduced even in a region downstream of the region where separation is reduced by the above configuration (1). As a result, it is possible to further suppress the occurrence of separation in the scroll passage, and further enlarge the operating region on the low flow rate side.

(3) In some embodiments, in the above configuration (2), the first region includes: a change rate decreasing region where the change rate of $F(\theta)$ decreases; and a change rate increasing region, downstream of the change rate decreasing region, where the change rate of $F(\theta)$ increases.

With the above configuration (3), a reduction in flow velocity of the compressed fluid is suppressed on the upstream side of the first region, while a reduction in flow velocity of the compressed air is mitigated on the downstream side of the first region. When the centrifugal compressor operates in the operating region on the low flow rate side, separation occurs in a circumferential-directional range of the angular position from 90° to 180°. Thus, by suppressing a reduction in flow velocity of the compressed fluid on the upstream side of the first region, it is possible to reliably achieve the state where separation is less likely to occur.

(4) In some embodiments, in the above configuration (3), the change rate decreasing region and the change rate increasing region are continuous, and an inflection point at which the change rate changes from decreasing to increasing is in a range of $\theta$ from 90° to 270°.

With the above configuration (4), since a reduction in flow velocity of the compressed fluid is reliably suppressed on the upstream side of the first region, it is possible to more reliably achieve the state where separation is less likely to occur.

(5) In some embodiments, in the above configuration (4), when $\theta_{IP}$ is an angular position of the inflection point, and in a cross-section obtained by cutting the scroll passage along a plane including the rotational axis of the impeller at a circumferential-directional position where the angular position is $\theta_{IP}$, $F_{IP}$ is defined as: $F_{IP}=(A_{IP}/R_{IP})/r$, where $A_{IP}$ is a cross-sectional area of the scroll passage, and $R_{IP}$ is a distance from the rotational axis to a scroll center of the cross-section of the scroll passage, $F_{IP}>F(\theta_{IP})$.

With the above configuration (5), at least in the change rate decreasing region leading to the inflection point of the first region, F(θ) is smaller than when F(θ) changes at the reference change rate. Thus, a region where a reduction in flow velocity of the compressed fluid is suppressed certainly exists in the first region. As a result, since the occurrence of separation is more reliably reduced in the scroll passage, it is possible to more reliably enlarge the operating region on the low flow rate side.

(6) In some embodiments, in any one of the above configurations (2) to (5), the scroll passage includes a second region where F(θ) changes at a larger change rate than the reference change rate at least partially in a range of θ from 270° to 360°.

With the above configuration (6), in the second region downstream of the region (first region) where separation is suppressed by any one of the above configurations (2) to (5), a reduction in flow velocity of the compressed fluid is mitigated compared with the case where F(θ) increases at the reference change rate in a range of the angular position from 60° to 360°. Thus, it is possible to achieve sufficient static pressure recovery.

(7) In some embodiments, in the above configuration (6), the scroll passage includes a third region where F(θ) changes at a smaller change rate than the reference change rate in a range of θ≤360° on a downstream side of the second region.

With the above configuration (7), in the third region downstream of the region where static pressure recovery is achieved by the above configuration (3), a reduction in flow velocity of the compressed fluid is suppressed compared with the case where F(θ) increases at the reference change rate in a range of the angular position from 60° to 360°. Thus, inertia causing the compressed fluid to flow toward the outlet of the scroll passage can be applied to the compressed fluid. As a result, it is possible to prevent the recirculation flow from the scroll passage to the diffuser passage from increasing more than necessary. Thus, it is possible to suppress a reduction in efficiency of the centrifugal compressor.

(8) A turbocharger according to at least one embodiment of the present disclosure comprises: the centrifugal compressor described in any one of the above (1) to (7).

With the above configuration (8), it is possible to enlarge the operating region of the centrifugal compressor on the low flow rate side.

Advantageous Effects

According to at least one embodiment of the present disclosure, 0.35≤F(360°)≤0.65 is satisfied. As a result, it is possible to balance an increase in friction loss in the operating region on the high flow rate side and a reduction in efficiency due to stall in the operating region on the low flow rate side. Additionally, since 0.08×F(360°)≤F(60°)≤0.4×F(360°) is satisfied, in the operating region on the low flow rate side, recirculation flow from the scroll passage to the diffuser passage is ensured in the vicinity of the circumferential-directional position at an angular position of 60°. This recirculation flow reduces the occurrence of separation in the scroll passage. As a result, since the occurrence of separation is reduced in the scroll passage, it is possible to enlarge the operating region on the low flow rate side.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A centrifugal compressor according to some embodiments of the present disclosure will be described by taking a centrifugal compressor of a turbocharger as an example. However, the centrifugal compressor in the present disclosure is not limited to a centrifugal compressor of a turbocharger, and may be any centrifugal compressor which operates alone. Although a fluid to be compressed by the compressor is air in the following description, the fluid may be replaced by any other fluid.

Figure 1:
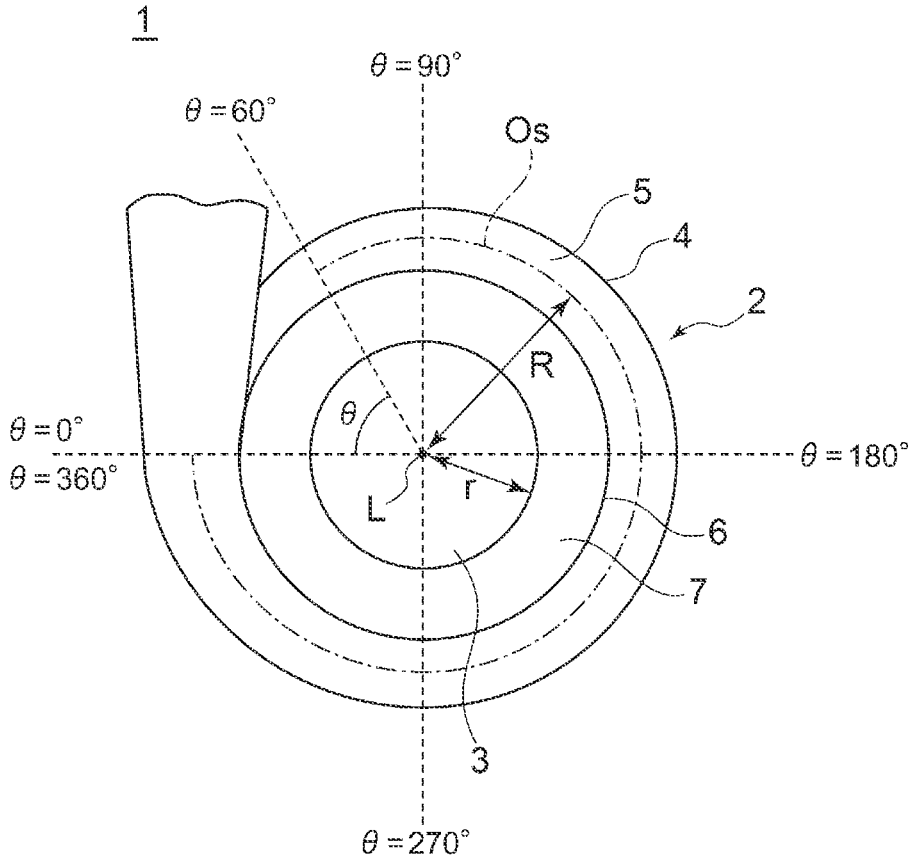
FIG. 1 is a schematic plan view of a centrifugal compressor according to an embodiment of the present invention.

As shown in FIG. 1, the centrifugal compressor 1 includes a housing 2 and an impeller 3 rotatably disposed around the rotational axis L within the housing 2. The housing 2 includes a scroll part 4 forming a scroll passage 5 of spiral shape on the outer peripheral side of the impeller 3, and a diffuser part 6 forming a diffuser passage 7 communicating with the scroll passage 5 along the circumferential direction of the scroll passage 5 on the radially inner side of the scroll passage 5.

In this disclosure, a circumferential-directional position with respect to the scroll end of the scroll part 4 is represented by a central angle about the rotational axis L, i.e., an angular position θ. Hence, the angular position θ representing the circumferential-directional position of the scroll end is 0°. However, the position of the scroll end having made one round along the scroll passage 5 from the scroll end is represented by an angular position θ of 360°. Further, a range in the circumferential direction can be represented by a range of the angular position θ. The range represented by the range of the angular position θ is defined as an angular range.

In a cross-section obtained by cutting the scroll passage 5 along a plane including the rotational axis L at a circumferential-directional position where the angular position is θ, F(θ) is defined as F(θ)=(A/R)/r, where A is a cross-sectional area of the scroll passage 5, R is a distance from the rotational axis L to the scroll center Os of the cross-section of the scroll passage 5, and r is a radius of the impeller 3.

In the centrifugal compressor 1, the value of F(θ) at an angular position θ of 360° satisfies $0.35 \leq F(360°) \leq 0.65$ (1).

Further, in the centrifugal compressor 1, the value of F(θ) at an angular position θ of 60° satisfies $0.08 \times F(360°) \leq F(60°) \leq 0.4 \times F(360°)$ (2).

Figure 2:
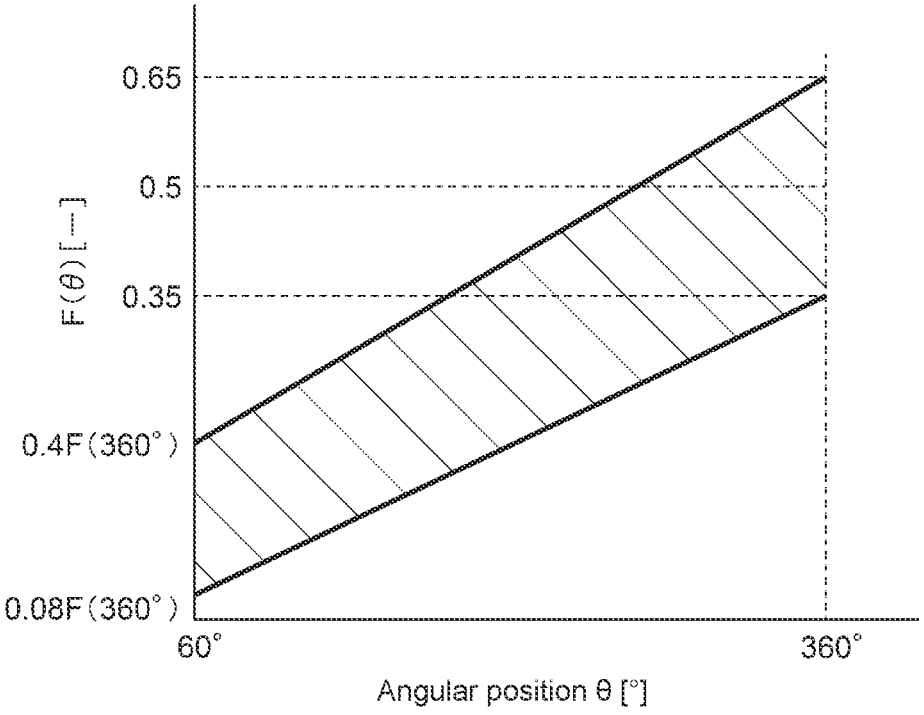
FIG. 2 is a graph showing the change of F(θ) of a scroll passage of a centrifugal compressor according to an embodiment of the present invention.

As shown in FIG. 2, in an angular range from 60° to 360°, the scroll passage 5 (see FIG. 1) is configured such that the value of F(θ) changes in a range shown by the hatched area.

The condition (1) indicates a range of F(360°)=0.5±30%. As shown in FIG. 1, when the centrifugal compressor 1 operates in the operating region on the high flow rate side, friction loss may increase at an angular position θ of 360°, while when the centrifugal compressor 1 operates in the operating region on the low flow rate side, efficiency may decreases due to stall at an angular position θ of 360°. By setting F(θ) to the condition (1), it is possible to balance these problems possibly caused in the operating region on the high flow rate side and in the operating region on the low flow rate side.

Further, in the operating region on the low flow rate side, the compressed air flowing through the scroll passage 5 cannot respond to the change in flow passage area of the scroll passage 5 (the change in flow velocity) and the change in curvature of the scroll passage 5 (the change in flowing direction), thus causing separation in the scroll passage 5 in an angular range from 90° to 180°. To solve this problem, by setting the condition (2), in the operating region on the low flow rate side, recirculation flow from the scroll passage 5 to the diffuser passage 7 can be ensured in the vicinity of the circumferential-directional position at an angular position of 60°. This recirculation flow reduces the occurrence of separation in the scroll passage 5 in an angular range from 90° to 180°. As a result, since the occurrence of separation is reduced in the scroll passage 5, it is possible to enlarge the operating region on the low flow rate side.

The condition (2) indicates that F(60°) is 8% to 40% of F(360°). If F(60°) is less than 8% of F(360°), since sufficient circulation flow cannot be ensured, the occurrence of separation cannot be sufficiently reduced. Further, if F(60°) is larger than 40% of F(360°), the effect of reducing the occurrence of separation by the recirculation flow no longer increase, but the disadvantages of excessive recirculation flow increases.

In the following embodiments, examples of the change in F(θ) in an angular range from 60° to 360° and effects attributable to the change in F(θ) will be described.

Figure 3:
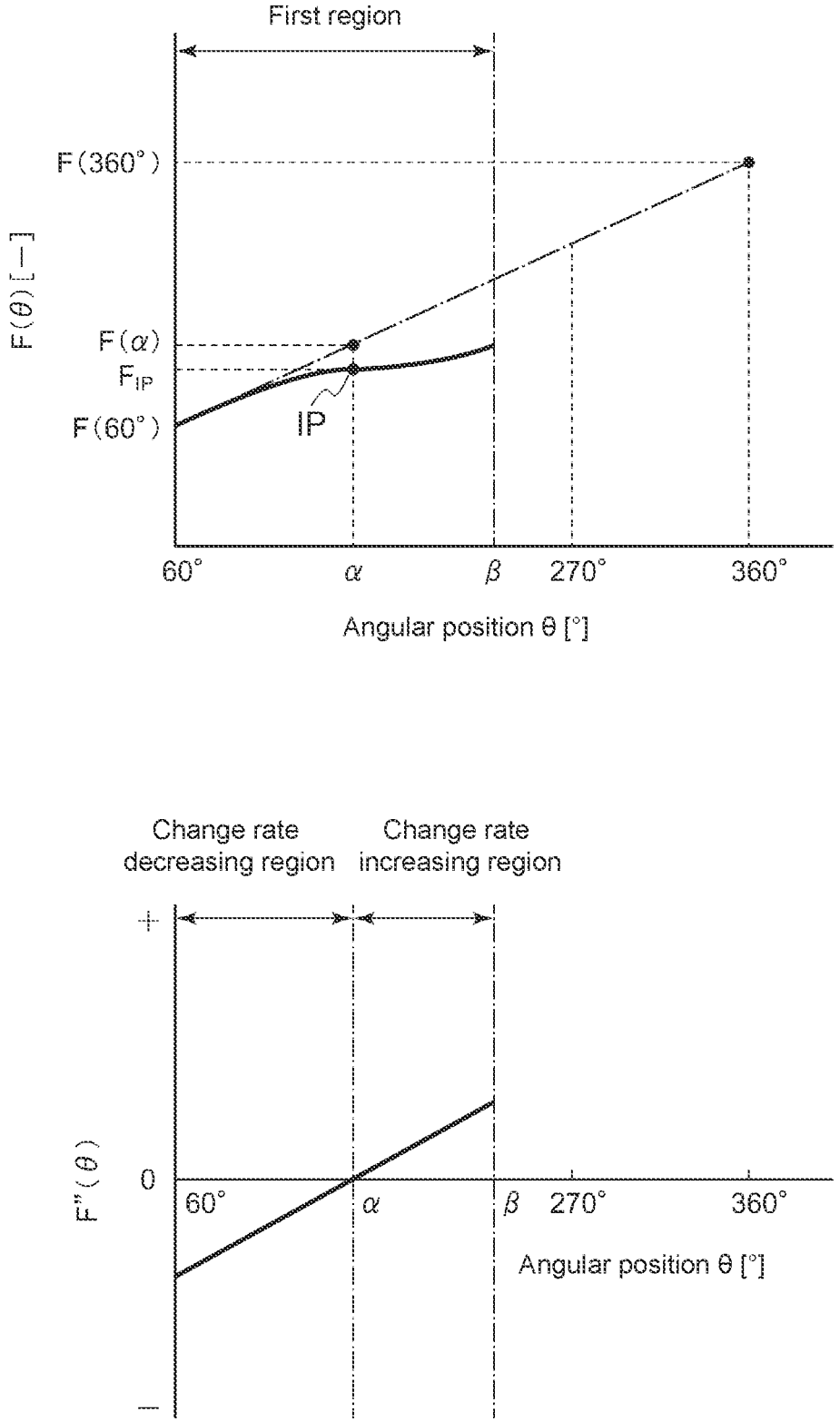
FIG. 3 is a graph showing an example of change rate of F(θ) of a scroll passage of a centrifugal compressor according to an embodiment of the present invention.

As shown in FIG. 3, assuming that a reference change rate Δ is a change rate at which F(θ) changes (increases) constantly in an angular range from 60° to 360°, the reference change rate Δ is defined as $\Delta=[F(360°)-F(60°)]/(360°-60°)$. In other words, the reference change rate Δ corresponds to the slope of the dashed dotted linear line in FIG. 3.

In an embodiment, the scroll passage 5 (see FIG. 1) includes a first region where F(θ) changes at a smaller change rate than the reference change rate Δ in an angular range θ from 60° to 270°. Here, the change rate of F(θ) corresponds to the slope of tangent to F(θ). Meanwhile, in a range from the downstream end of the first region to an angular position θ of 360°, F(θ) may change in any manner. In the first region, since the enlargement rate of the cross-sectional area of the scroll passage 5 is smaller than when F(θ) changes at the reference change rate Δ, a reduction in flow velocity of the compressed air flowing through the scroll passage 5 is suppressed in the first region. Thus, the occurrence of separation is reduced even in a region downstream of the region where separation in the scroll passage 5 is suppressed by the setting of F(60°) and F(360°). As a result, it is possible to further suppress the occurrence of separation in the scroll passage 5, and further enlarge the operating region on the low flow rate side.

The change rate of F(θ) may be smaller than the reference change rate Δ over the entire angular range from 60° to 270°, or the change rate of F(θ) may be smaller than the reference change rate Δ in a part of the angular range from 60° to 270°. In the latter case, a region where the change rate of F(θ) is smaller than the reference change rate Δ is the first region. Thus, the scroll passage 5 may include the first region at least partially in an angular range from 60° to 270°.

In this embodiment, as long as the change rate of F(θ) is smaller than the reference change rate Δ, F(θ) may change at any change rate. As an example, FIG. 3 shows a graph of the angular position θ and a second derivative F"(θ) of F(θ). The first region may include a change rate decreasing region where $F''(\theta)<0$ in a range of the angular position θ from 60° to α (<270°), and a change rate increasing region where $F''(\theta)>0$ in a range of the angular position from α to β ($\alpha<\beta\leq 270°$).

With this configuration, since the change rate of F(θ) decreases on the upstream side (in a range from 60° to α) of the first region, a reduction in flow velocity of the compressed air is suppressed. In contrast, since the change rate of F(θ) increases on the downstream side (in a range from α to β) of the first region, a reduction in flow velocity of the compressed air is mitigated. When the centrifugal compressor operates in the operating region on the low flow rate side, separation occurs in a circumferential-directional range of the angular position from 90° to 180°. Thus, by suppressing a reduction in flow velocity of the compressed air on the upstream side of the first region, it is possible to reliably achieve the state where separation is less likely to occur.

An angular range where $F''(\theta)=0$ may exist between the change rate decreasing region and the change rate increasing region. In the example of FIG. 3, the change rate decreasing region and the change rate increasing region are continuous, and an inflection point IP, at which the change rate changes from decreasing to increasing, may be in an angular range from 90° to 270°. With this configuration, since a reduction in flow velocity of the compressed air is reliably suppressed on the upstream side of the first region, it is possible to more reliably achieve the state where separation is less likely to occur.

Further, in the example of FIG. 3, when, in a cross-section obtained by cutting the scroll passage 5 (see FIG. 1) along a plane including the rotational axis L (see FIG. 1) at a circumferential-directional position where an angular position $\theta_{IP}$ of the inflection point IP is α ($\theta_{IP}=\alpha$), $F_{IP}$ is defined as $F_{IP}=(A_{IP}/R_{IP})/r$ where $A_{IP}$ is a cross-sectional area of the scroll passage 5, and $R_{IP}$ is a distance from the rotational axis L to the scroll center Os (see FIG. 1) of the cross-section of the scroll passage 5, $F_{IP}$ may be smaller than F(α) ($F_{IP}<F(\alpha)$).

With this configuration, at least in the change rate decreasing region leading to the inflection point IP of the first region, F(θ) is smaller than when F(θ) changes at the reference change rate Δ. Thus, a region where a reduction in flow velocity of the compressed air is suppressed certainly exists in the first region. As a result, since the occurrence of separation is more reliably reduced in the scroll passage 5, it is possible to more reliably enlarge the operating region on the low flow rate side.

Figure 4:
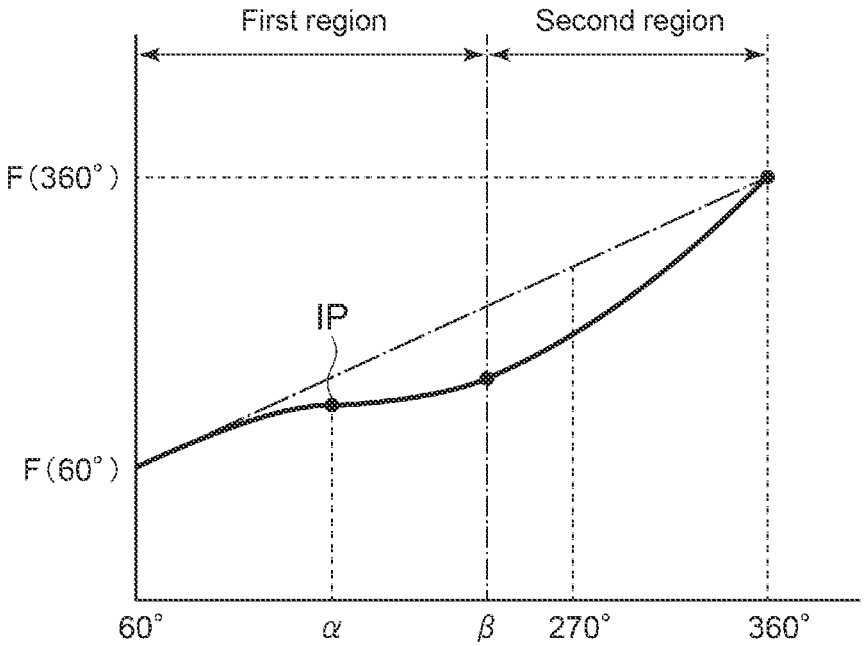
FIG. 4 is a graph showing another example of change rate of F(θ) of a scroll passage of a centrifugal compressor according to an embodiment of the present invention.

FIG. 4 shows another embodiment. In the embodiment of FIG. 4, starting from the embodiment of FIG. 3, the change rate of F(θ) on the downstream side of the first region is specified. Therefore, the configuration of the first region is the same as that of the embodiment of FIG. 3. In this embodiment, in an angular range of θ≤360° on the downstream side of the first region, i.e., in an angular range from β to 360°, the scroll passage 5 (see FIG. 1) includes a second region where F(θ) changes at a larger change rate than the reference change rate Δ. In the second region, since the enlargement rate of the cross-sectional area of the scroll passage 5 is larger than when F(θ) changes at the reference change rate Δ, a reduction in flow velocity of the compressed air flowing through the scroll passage 5 is mitigated. Thus, it is possible to achieve sufficient static pressure recovery.

Although in the embodiment of FIG. 4, the angular range from β to 360° is the second region, the second region is not limited to this range. The region where F(θ) is larger than when changing at the reference change rate Δ may be at least in an angular range from 270° to 360°. In this case, a region where the change rate of F(θ) is larger than the reference change rate Δ is the second region. Thus, the scroll passage 5 may include the second region where F(θ) changes at a larger change rate than the reference change rate Δ at least partially in an angular range from 270° to 360°.

Figure 5:
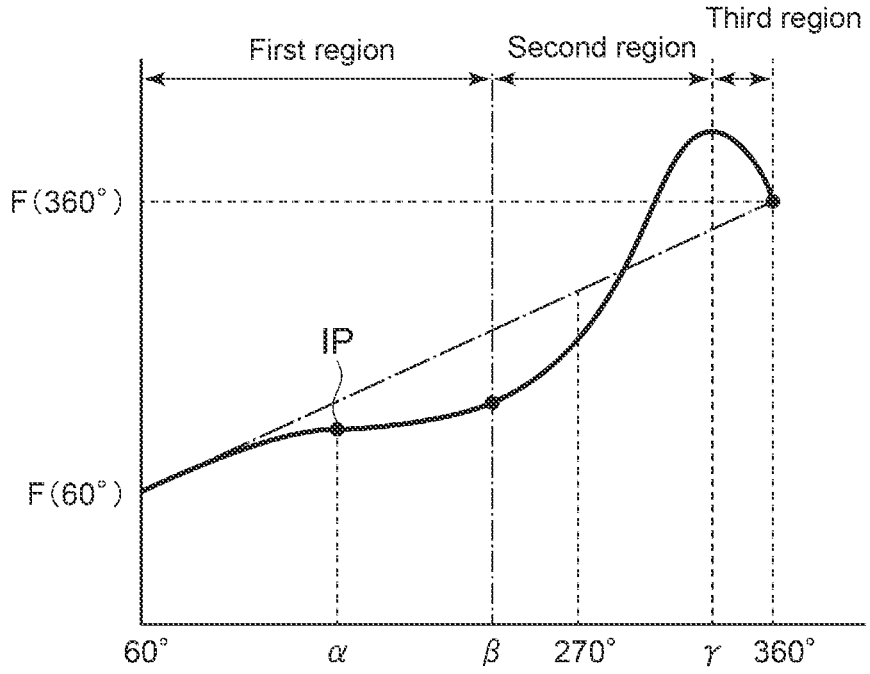
FIG. 5 is a graph showing still another example of change rate of F(θ) of a scroll passage of a centrifugal compressor according to an embodiment of the present invention.

FIG. 5 shows still another embodiment. In the embodiment of FIG. 5, starting from the embodiment of FIG. 4, the change rate of F(θ) in a range from 270° to 360° is modified. In this embodiment, the second region in a range from 270° to 360° includes a region where the value of F(θ) is larger than when F(θ) changes (increases) at the reference change rate Δ in an angular range from 60° to 360°. In an angular range of θ≤360° on the downstream side of the second region, i.e., in an angular range from γ (>270°) to 360°, the scroll passage 5 (see FIG. 1) includes a third region where F(θ) changes (decreases) at a smaller change rate than the reference change rate Δ, in the embodiment of FIG. 5, at a negative change rate.

In the third region, since the enlargement rate of the cross-sectional area of the scroll passage 5 is smaller than when F(θ) changes at the reference change rate Δ, a reduction in flow velocity of the compressed air is suppressed. Thus, inertia causing the compressed air to flow toward the outlet of the scroll passage 5 can be applied to the compressed air. As a result, it is possible to prevent the recirculation flow from the scroll passage 5 to the diffuser passage 7 (see FIG. 1) from increasing more than necessary. Thus, it is possible to suppress a reduction in efficiency of the centrifugal compressor 1 (see FIG. 1).

Although in the embodiments of FIGS. 3 to 5, the scroll passage 5 includes the first region where F(θ) changes at a smaller change rate than the reference change rate Δ in an angular range θ from 60° to 270°, the scroll passage 5 may include the first region in an angular range θ from 120° to 270°. As described above, in the operating region on the low flow rate side, separation occurs in the scroll passage 5 in an angular range from 90° to 180°. In an upstream part of this separation occurrence range, i.e., in a region including an angular range from 90° to 120°, the occurrence of separation can be reduced by the setting of the conditions (1) and (2); and in a downstream part of this separation occurrence range, i.e., in a region including an angular range from 120° to 180°, the occurrence of separation can be reduced by making the change rate of F(θ) smaller than the reference change rate Δ. In this case, the inflection point IP in the embodiment of FIG. 3 is in an angular range from 180° to 270°.

As described above, when 0.35≤F(360°)≤0.65 is satisfied, it is possible to balance an increase in friction loss in the operating region on the high flow rate side and a reduction in efficiency due to stall in the operating region on the low flow rate side. Additionally, when 0.08×F(360°)≤F(60°)≤0.4×F(360°) is satisfied, in the operating region on the low flow rate side, recirculation flow from the scroll passage 5 to the diffuser passage 7 is ensured in the vicinity of the circumferential-directional position at an angular position of 60°. This recirculation flow reduces the occurrence of separation in the scroll passage 5 in an angular range from 90° to 180°. As a result, since the occurrence of separation is reduced in the scroll passage 5, it is possible to enlarge the operating region on the low flow rate side.

REFERENCE SIGNS LIST

1 Centrifugal compressor
2 Housing
3 Impeller
4 Scroll part
5 Scroll passage
6 Diffuser part
7 Diffuser passage
IP Inflection point
Os Scroll center
Δ Reference change rate
θ Angular position

The invention claimed is:

1. A centrifugal compressor comprising:

an impeller; and a housing having a scroll passage of spiral shape formed on an outer peripheral side of the impeller, wherein, when a circumferential-directional position of the scroll passage is represented by an angular position with respect to a scroll end of the scroll passage, and in a cross-section obtained by cutting the scroll passage along a plane including a rotational axis of the impeller at a circumferential-directional position where the angular position is θ, F(θ) is defined as:

$$F(\theta)=(A/R)/r,$$

where A is a cross-sectional area of the scroll passage, R is a distance from the rotational axis to a scroll center of the cross-section of the scroll passage, and r is a radius of the impeller, $$0.35)\leq F(360°)\leq 0.65, \text{ and}$$

$$0.08\times F(360°)\leq F(60°)\leq 0.4\times F(360°),$$

wherein, when a reference change rate Δ which is a change rate of F(θ) in a range of θ from 60° to 360° is defined as:

$$\Delta=[F(360°)-F(60°)]/(360°-60°),$$

the scroll passage includes a first region where F(0) changes at a smaller change rate than the reference change rate at least partially in a range of θ from 60° to 270°, and wherein the first region includes:

a change rate decreasing region where the change rate of F(θ) decreases; and a change rate increasing region, downstream of the change rate decreasing region, where the change rate of F(θ) increases.

2. The centrifugal compressor according to claim 1, wherein the change rate decreasing region and the change rate increasing region are continuous, and an inflection point at which the change rate changes from decreasing to increasing is in a range of θ from 90° to 270°.

3. A turbocharger comprising the centrifugal compressor according to claim 1.

4. The centrifugal compressor according to claim 1, wherein the scroll passage includes a second region where F(θ) changes at a larger change rate than the reference change rate at least partially in a range of θ from 270° to 360°.

5. The centrifugal compressor according to claim 4, wherein the scroll passage includes a third region where F(θ) changes at a smaller change rate than the reference change rate in a range of θ≤360° on a downstream side of the second region.

* * * * *